US006016098A

United States Patent [19]

Onishi et al.

[11] Patent Number: 6,016,098

[45] Date of Patent: Jan. 18, 2000

[54] VARIABLE RESISTOR

[75] Inventors: Katsuhiro Onishi, Sabae; Kiminori Yamauchi, Fukui; Hideaki Tsukada, Sabae; Yukinori Ueda; Fumitoshi Masuda, both of Fukui-ken, all of Japan

[73] Assignee: Murata Manufacturing Co., Ltd., Nagaokakyo, Japan

[21] Appl. No.: 08/980,299

[22] Filed: Nov. 28, 1997

[30] Foreign Application Priority Data

Nov. 28, 1996 [JP] Japan ..... 8-318356

[51] Int. Cl.[7] ..... H01C 10/30

[52] U.S. Cl. ..... 338/160; 338/162; 338/163

[58] Field of Search ..... 338/162, 163, 338/164, 184, 171

[56] References Cited

U.S. PATENT DOCUMENTS 4,998,088 3/1991 Masura ..... 338/162

5,053,742 10/1991 Masura ..... 338/162

5,305,110 4/1994 Taki et al. ..... 348/836

5,790,012 8/1998 Nakatsu et al. ..... 338/152

*Primary Examiner*—Lincoln Donovan

*Assistant Examiner*—Richard K. Lee

*Attorney, Agent, or Firm*—Burns, Doane, Swecker & Mathis, LLP

[57] ABSTRACT

A first rotor and a second rotor are prepared. The first rotor has a resistor and inner-peripheral and outer-peripheral electrodes respectively connected to end portions of this resistor. The second rotor has a resistor and inner-peripheral and outer-peripheral electrodes symmetrical with those of the first rotor, provided at a position corresponding to that obtained by rotating the first rotor about the axis of the first rotor by an angle of 180° with respect to the first rotor. A variable resistor selectively uses either one of the first rotor and second rotor. This makes it possible to provide a variable resistor which requires few parts. Also, this makes it possible to reduce the kinds of bending operations that must be performed on the terminals.

13 Claims, 17 Drawing Sheets

FIG. 24
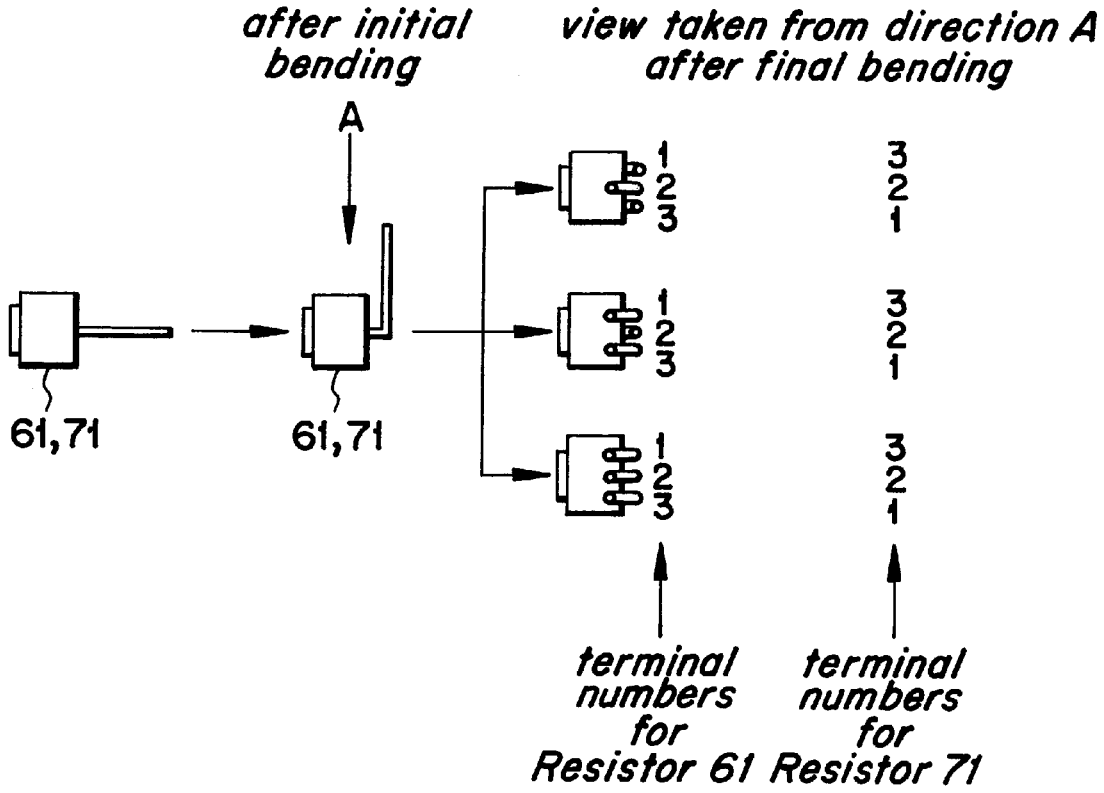
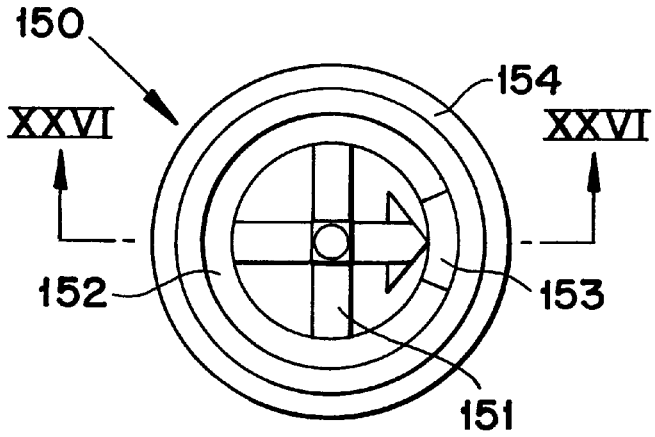
FIG. 25

FIG. 35
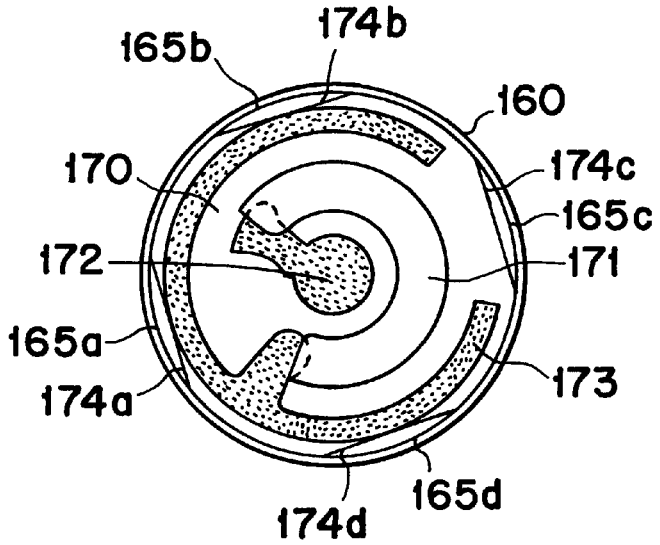
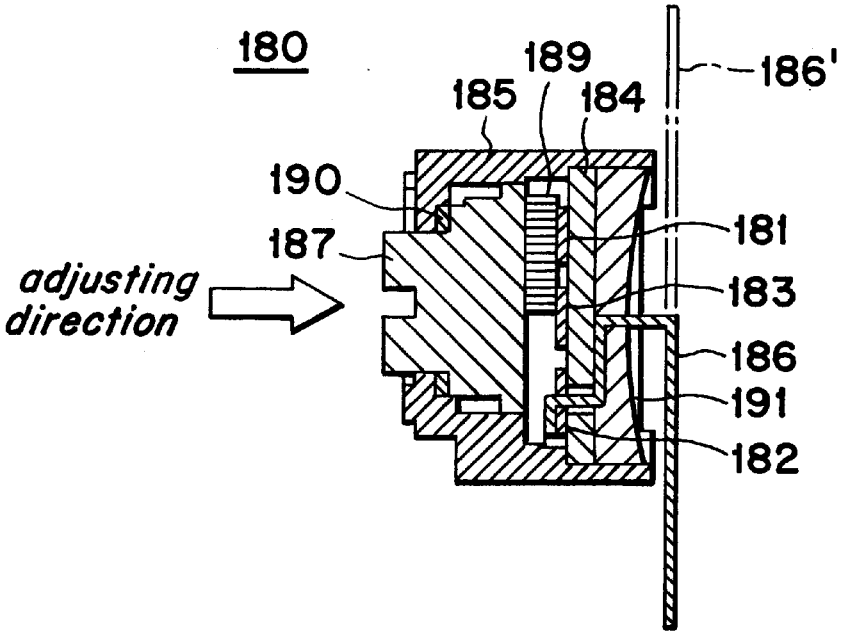
FIG. 36
(PRIOR ART)

VARIABLE RESISTOR

BACKGROUND OF THE INVENTION

This application corresponds to Japanese Patent Application No. 8-318356, filed on Nov. 28, 1996, which is hereby incorporated by reference in its entirety herein.

1. Field of the Invention

The present invention relates to a variable resistor and, more particularly, to a residue-proof (e.g., dust-proof) variable resistor equipped with a case. The invention also pertains to a method for producing such a variable resistor.

2. Description of the Related Art

FIG. 36 shows a conventional variable resistor. The variable resistor 180 comprises an alumina substrate 184 having on its surface a horseshoe resistor 181, collector electrode thin film 183 and electrode thin films 182 respectively connected to end portions of the horseshoe resistor 181. A case 185 is provided for accommodating the alumina substrate 184 therein. Three lead terminals 186 (one of which is shown in FIG. 36) are allowed to pass through the alumina substrate 184 and are respectively soldered to the electrode thin films 182 and 183. A rotor 187 is accommodated in the case 185. A slider 189 is disposed on a rear surface of the rotor 187. A sealing O-ring 190 is disposed on the rotor 187 and a resin 191 is provided for sealing an opening in the rear surface of the case 185. Furthermore, when this variable resistor 180 is configured into a so-called "side surface adjusting type variable resistor", wherein the resistance value is adjusted by rotating the rotor 187 from an arrow-indicated direction illustrated in FIG. 36, the lead terminals 186 are bent along the rear surface of the case 185.

An explanation will be given of the terminal numbers 1, 2 and 3 illustrated in FIG. 37 with reference to FIG. 38. It is now assumed that the lead terminal number 2 is the terminal connected to the slider 189 brought into sliding contact with the resistor 181. Next, it is assumed that the lead terminal number 3 is the terminal electrically connected to the end portion side of the resistor 181 on a side such that when the rotor 187 is rotated to the right the resistance value between this lead terminal and the lead terminal corresponding to the terminal number 2 becomes smaller. Finally, the lead terminal number 1 is the terminal electrically connected to the other end portion side of the resistor 181 on a side such that when the rotor 187 is rotated to the right the resistance value between this lead terminal and the lead terminal corresponding to the terminal number 2 becomes larger.

In the variable resistor 180 of the side surface adjusting types various combinations are made among the resistance value adjusting direction, lead terminal pitches and lead terminal numbers. To accommodate these changes, it was necessary that many kinds of constituent parts be prepared and many kinds of processing methods be executed. In particular, regarding the complex bending of the lead terminals 186, as illustrated in FIG. 37, two kinds of initial bending are included (i.e., a case where the lead terminal is bent into the lead terminal 186 indicated in a solid line shown in FIG. 36 and a case where the lead terminal is bent into the lead terminal 186' indicated in a one-dot chain line shown in the same figure). There are three kinds of subsequent bending, including a first kind corresponding to a state in which the terminal numbers 1, 2 and 3 are arranged in one row in this order, a second kind corresponding to a state in which the terminal number 2 is located on the left side of the terminal numbers 1 and 3, and a third kind corresponding to a state in which the terminal number 2 is located on the right side of the terminal numbers 1 and 3. This is shown in FIG. 37. The second column of permutations in this figure corresponds to the initial bending operation and the third column of permutations in this figure corresponds to the subsequent bending operations. More specifically, the third column represents a view of the components taken from the direction As after completion of all bending steps.

The subsequent bending after the initial bending is three in kind with respect to each of the two kinds of initial bending. Thus, six bending methods become necessary. This made the manufacture and management of these parts complex, which hindered productivity.

SUMMARY OF THE INVENTION

The present invention has an object to provide a variable resistor which has a small number of constituent parts and can reduce the kinds of the terminal bending operations required.

To attain the above object, there is provided a variable resistor comprising a first rotor or a second rotor, the first rotor having provided on its surface a resistor and an electrode connected to at least one end portion of the resistor. The second rotor has provided thereon a resistor and electrode at a position obtained by rotating a resistor and electrode symmetrical with those of the first rotor through an angle of 180° with respect to the first rotor. The variable resistors further includes at least two slide contactors, and a case provided with a recess portion, whereby either one of the first and second rotors is rotatably accommodated in the recess portion of the case having the slide contactors exposed in a bottom surface thereof. The slide contactors contact the resistor and electrode when the rotor is disposed in the recess. A cover is mounted on an opening of the recess portion of the case.

Here, preferably, the resistor provided on each of the first and second rotors is shaped like a horseshoe and the electrode provided on each of the first and second rotors is formed concentrically with the horseshoe resistor. Also, the variable resistor can be of a structure wherein a lead terminal separate from the slide contactor is connected to this slide contactor. Also, the rotors can each be made of insulating resin or ceramic having the resistor and electrode provided on their surface. Further, the rotors can be constructed by combining the substrate having the resistor and electrode provided on their surface and a main body.

Thus, two kinds of rotors are provided, one of which is a first rotor and the other of which is a second rotor having provided thereon a resistor and electrode at a position obtained by rotating a resistor and electrode symmetrically with those of the first rotor through an angle of 180° with respect to the first rotor. One of these rotors is selected and then inserted in the case. The terminal number is changed and, as a result, initial bending of the terminal is reduced from the convention two kinds of bending operations to one kind of bending operation.

Also, the cover has mounting claw portions disposed in 180° rotation symmetry about a rotation axis of the first and second rotors, and these mounting claw portions are inserted by force into holes provided in the case, whereby the cover is mounted on the case.

The variable resistor can be configured as a sealed structure by mounting the cover onto the opening of the case via an O-ring. Also, by the cover being mounted by a forced insertion method, the conventional sealing operation based on the use of resin becomes unnecessary and in addition the resulting variable resistor requires fewer assembling steps and thus productivity of these devices improves. The forward end portions of the mounting claw portions of the cover are folded back and slits and engagement portions are provided in and on the mounting claw portions. This structure helps prevent the cover from coming off.

Also, the cover has an adjusting opening at its central part and at least one of bending and burring is performed of the edge portion of this adjusting opening toward the side of the rotor. By performing bending or burring of the edge of the adjusting hole provided at the central part of the cover, the insertability of the driver at the adjusting time and the strength of the cover itself is increased. Accordingly, the deformation of the top surface of the cover after the mounting of it is prevented and the contact reliability of the contact between the resistor or electrode and the slide contactor is enhanced.

Further, the variable resistor according to the present invention has an adaptor for maintaining the terminal pitch dimension. By this adaptor, the terminal pitch dimension is maintained stably.

BRIEF DESCRIPTION OF THE DRAWINGS

The foregoing, and other, objects, features and advantages of the present invention will be more readily understood upon reading the following detailed description in conjunction with the drawings in which:

FIG. 24 is an explanatory view illustrating the kind of the bending methods (operations) for the variable resistor;

FIG. 25 is a plan view illustrating a first rotor used in another embodiment of the present invention;

FIG. 35 is a bottom surface view illustrating the first rotor illustrated in FIG. 33;

FIG. 36 is a sectional view illustrating a conventional variable resistor;

DETAILED DESCRIPTION OF THE PREFERRED EMBODIMENTS

An embodiment of a variable resistor according to the present invention will now be explained with reference to the appended drawings.

Figure 1:
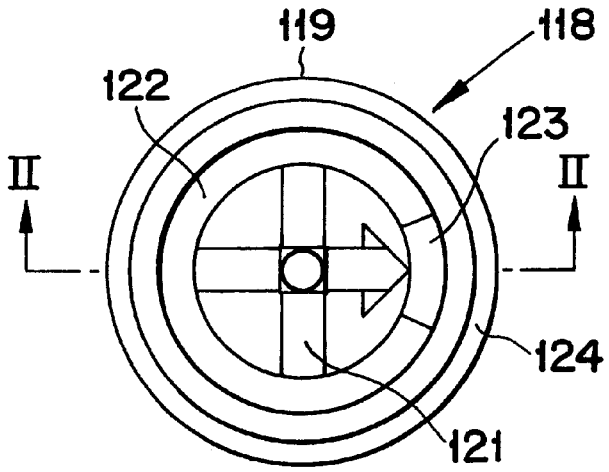
FIG. 1 is a plan view illustrating a first rotor used in an embodiment of a variable resistor according to the present invention.
Figure 2:
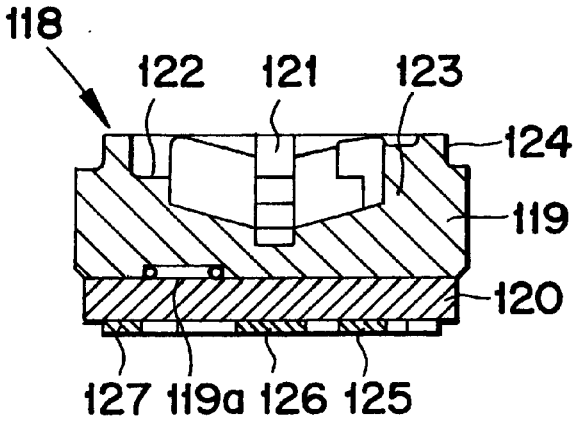
FIG. 2 is a sectional view taken along a line II—II of the first rotor illustrated in FIG. 1.
Figure 3:
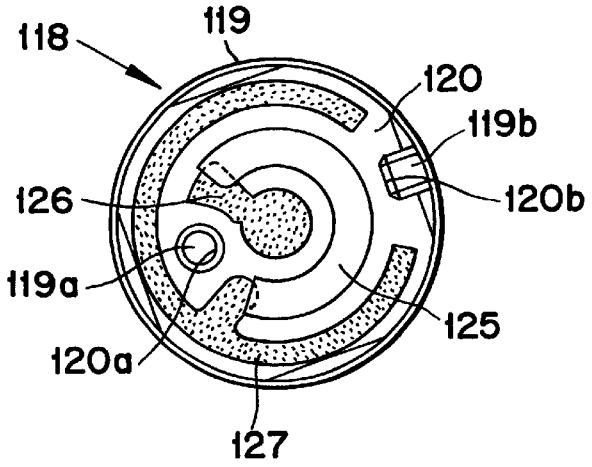
FIG. 3 is a bottom surface view illustrating the first rotor illustrated in FIG. 1.

As illustrated in FIGS. 1 to 3, a first rotor 118 used in a variable resistor according to this embodiment is substantially shaped like a circular column and is composed of a main body 119 and a substrate 120 bonded to the underside of this main body 119. At a central part of the upper surface of the main body 119 there is provided a crossed groove 121 or use in conjunction with a driver. Around the crossed groove 121 there is provided an escape groove 122 substantially shaped like a circular arc. Further, a stopper 123 is provided in contact with a prescribed position of this escape groove 122. A notch 124 is provided in the outer-peripheral edge portion of the upper surface of the main body 119. On the underside of the main body 119 there are provided projections 119*a* and 119*b*.

In the substrate 120 there are provided a hole 120*a* and a notch 120*b*. The hole 120*a* and notch 120*b* conform with the projections 119*a* and 119*b*, respectively. The displacement between the main body 119 and the substrate 120 due to the rotation thereof is prevented by the projections 119*a* and 119*b* being fitted into the hole 120*a* and notch 120*b*, respectively. Further, a horseshoe resistor 125 is provided on the underside of the substrate 120 by screen printing or transfer. Both end portions of the resistor 125 are electrically connected to an inner-peripheral electrode 126 and an outer-peripheral electrode 127. The inner-peripheral electrode 126 and outer-peripheral electrode 127 are formed concentrically with the horseshoe resistor 125. The inner-peripheral electrode 126 has a circular portion at the central part of the substrate 120 while, on the other hand, the outer-peripheral electrode 127 has a circular arc portion at the outer-peripheral part of the substrate 120.

The main body 119 and the substrate 120 are fabricated using ceramic material such as alumina or using a heat-resisting resin such as polyphenylene sulfide, and the resistor 125 is fabricated using a cerment resistor or carbon resistor. If, for example, inexpensive polyphenylene sulfide resin or glass epoxy resin is used as the material of the main body 119 and substrate 120 and an inexpensive carbon resistor is used as the resistor 125, it is possible to reduce the manufacturing cost of the variable resistor.

Figure 4:
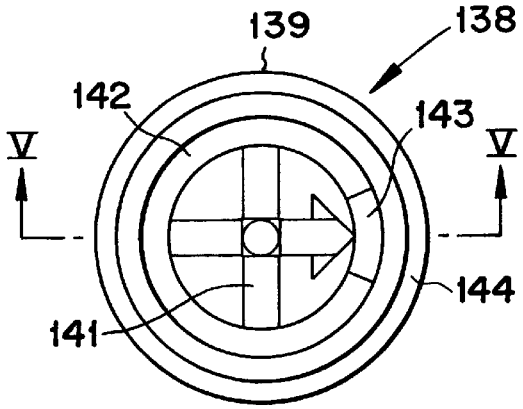
FIG. 4 is a plan view illustrating a second rotor.
Figure 5:
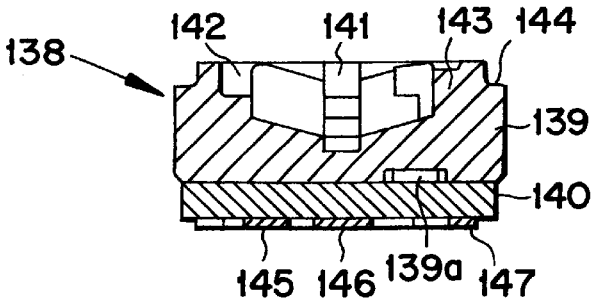
FIG. 5 is a sectional view taken along a V—V of the second rotor illustrated in FIG. 4.
Figure 6:
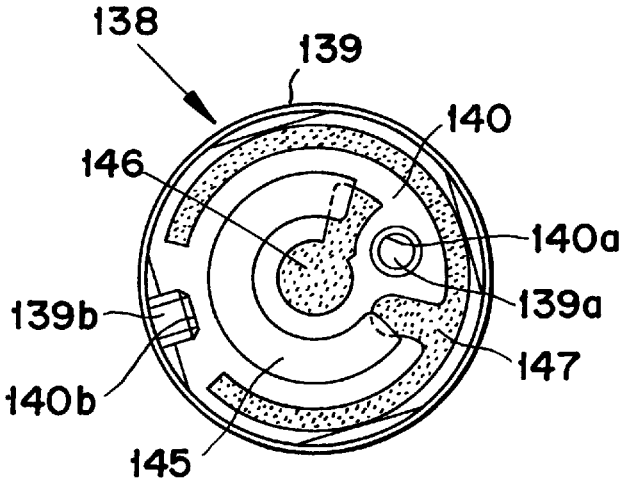
FIG. 6 is a bottom surface view illustrating the second rotor illustrated in FIG. 4.

Further, as illustrated in FIGS. 4 to 6, a second rotor is prepared having a resistor and inner-peripheral and outer-peripheral electrodes provided at a position corresponding to that obtained by rotating a resistor and inner-peripheral and outer-peripheral electrodes symmetrical with those of the first rotor 118 about the axis of the first rotor 118 through an angle of 180° with respect to the first rotor 118. The second rotor 138 is substantially shaped like a circular column and is composed of a main body 139 and a substrate 140 bonded to the underside of this main body 139. At the central part of the upper surface of the main body 139 there is provided a crossed groove 141 for use in conjunction with a driver. Around the crossed groove 141 there is provided an escape groove 142 substantially shaped like a circular arc. Further, a stopper 143 is provided in contact with a prescribed position of this escape groove 142. A notch 144 is provided in the outer-peripheral edge portion of the upper surface of the main body 139. On the underside of the main body 139 there are provided projections 139*a* and 139*b*.

In the substrate 140 there are provided a hole 140*a* and a notch 140*b*. The hole 140*a* and notch 140*b* positionally conform with the projections 139*a* and 139*b*. The displacement between the main body 139 and the substrate 140 due to the rotation thereof is prevented by the projections 139*a* and 139*b* being fitted into the hole 140*a* and notch 140*b*, respectively. The position of the projections 139*a*, 139*b* and the hole 140*a* and notch 140*b* corresponds to the position obtained by rotating the projections 119*a*, 119*b* and the hole 120*a* and notch 120*b* of the first rotor 118 about the axis of the first rotor 118 through an angle of 180°.

Further, a horseshoe resistor 145 is provided on the underside of the substrate 140. End portions of the resistor 145 are electrically connected to an inner-peripheral electrode 146 and an outer-peripheral electrode 147, respectively. The inner-peripheral electrode 146 and outer-peripheral electrode 147 are formed concentrically with the horseshoe resistor 145. The inner-peripheral electrode 146 has a circular portion at the central part of the substrate 140 while, on the other hand, the outer-peripheral electrode 147 has a circular arc portion at the outer-peripheral part of the substrate 140. The position of the resistor 145 and electrodes 146, 147 corresponds to the position obtained by respectively rotating the resistor 125 and electrodes 126, 127 of the first rotor 118 about the axis of the first rotor 118 through an angle of 180°.

As illustrated in FIGS. 7 to 10, a case 2 has a recess portion 3. The recess portion 3 has a circular shape in cross section in conformity with the configuration of the first or second rotor 118, 138 and is thereby designed so that the first or second rotor 118, 138 can be smoothly rotated when accommodated in the recess portion 3. Also, the depth of the recess portion 3 of the case 2 is set so that the upper surface of the first rotor 118 or second rotor 138 is slightly higher than the upper surface of the recess portion 3 of the case 2. This is for the purpose of making a reliable contact between the first rotor 118 and a metal cover 30 and thereby making the backlash of the first rotor 118 small.

A hole is provided at each of four corners of the upper surface of the case 2. The case 2 is made of polyamide system nylon having a high resistance to heat, such as 46 nylon, thermoplastic resin such as polyphenylene sulfide, polybutylene terephthalate or liquid crystal polymer, or thermosetting resin such as epoxy or diallyl phthalate. If especially using a polyphenylene sulfide resin, the resistance to moisture is also enhanced. Also, the use of a thermoplastic resin facilitates the fusion of the case to an adaptor, as later described.

Figure 7:
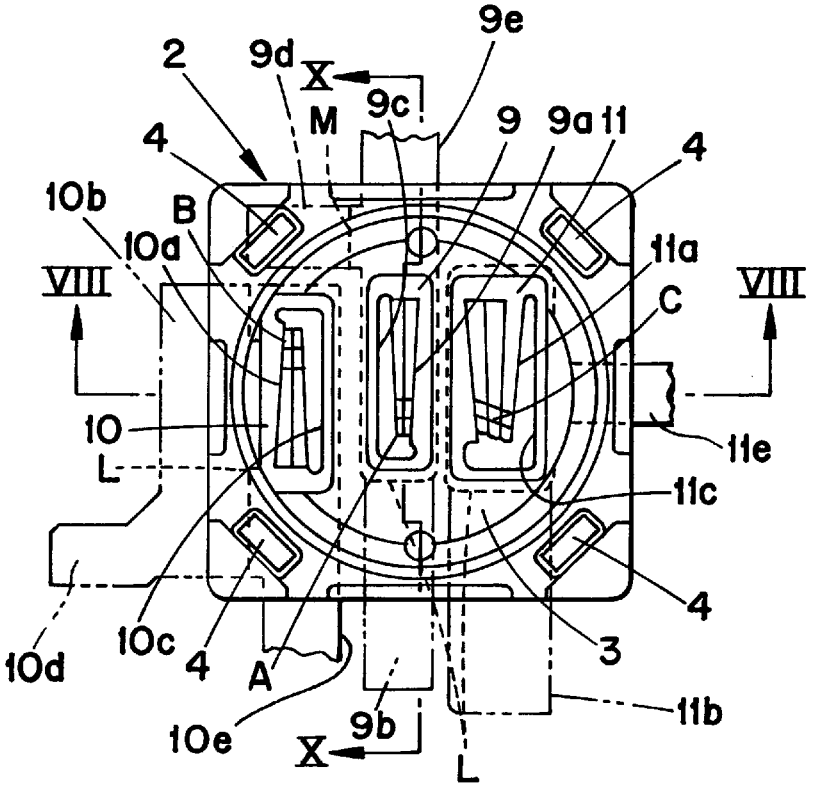
FIG. 7 is a plan view illustrating a case used in the embodiment of the variable resistor.
Figure 8:
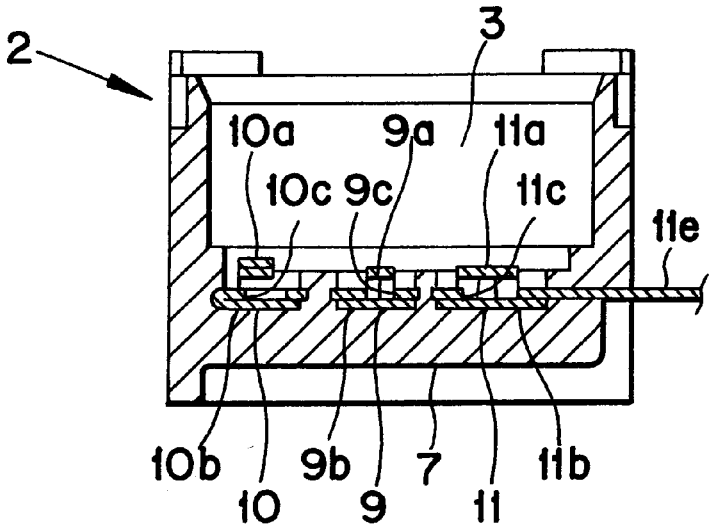
FIG. 8 is a sectional view taken along a line VIII—VIII of the case illustrated in FIG. 7.
Figure 9:
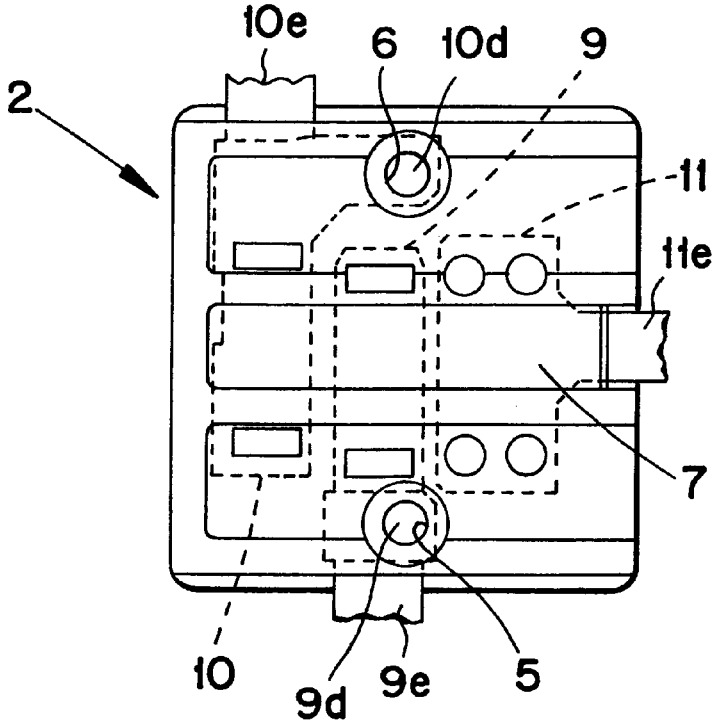
FIG. 9 is a bottom surface view illustrating the case illustrated in FIG. 7.
Figure 10:
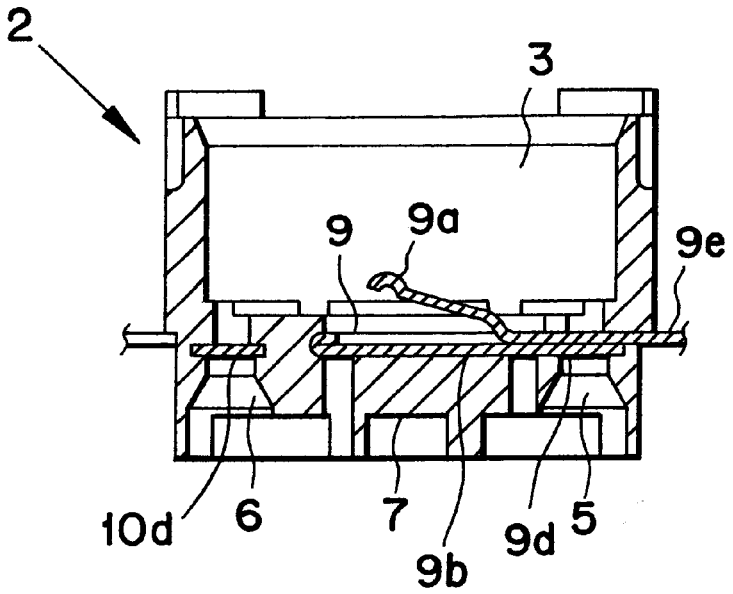
FIG. 10 is a sectional view taken along a line X—X of the case illustrated in FIG. 7.

Slide contactors 9, 10 and 11 are, for example, insert molded in a bottom portion of the case 2 and are partly exposed from the bottom surface of the recess portion 3 of the case 2. The slide contactors 9 to 11 are structured such that their bottom portions 9*b* to 11*b*, indicated in two-dot chain lines in FIG. 7, are each folded back at a folding-back line L, and each folded-back bottom portion is thereby disposed over the corresponding remaining bottom portion, the two bottom portions being thus doubled. By virtue of these bottom portions 9*b* to 11*b*, the underside of the slide contactors 9 to 11 are lidded to ensure a seal for the interior of the case 2. This, in conjunction with the outer-peripheral portions of the slide contactors 9 to 11, prevents molten resin from flowing onto the surfaces of arms 9*a* to 11*a* when resin-molding the case 2. This prevents the molten resin from attaching onto the arms, which, in turn, simplifies the resin molding process.

The respective arms 9*a*, 10*a* and 11*a* provided at the central portions of the slide contactors 9, 10 and 11 protrude from the bottom surface of the recess portion 3. Each of these arms is shaped like a comb. The arms 9*a* to 11*a* contact, at their contact portions A, B and C, with the circular portion of the electrode 126 or 146, the circular arc portion of the electrode 127 or 147 and the resistor 125 or 145 of the first or second rotor 118 or 138, respectively. The outer-peripheral portions of the slide contactors 9 to 11 are embedded in the case 2. At the central portions thereof, where the arms 9*a* to 11*a* are provided, there are provided substantially L-shaped (or substantially horizontally U-shaped) notches 9*c* to 11*c*. By providing these notches 9*c* to 11*c*, the formation of the comb-shaped arms 9*a* to 11*a* is facilitated and the spring property of the arms 9*a* to 11*a* is improved.

Further, the slide contactor 9 is arranged such that a "land" 9*d* for connection of a lead terminal, indicated in a two-dot chain line in FIG. 7, is folded back at a folding-back line M. The lead terminal connection land 9*d* is exposed in an opening 5 for the lead terminal which is provided in the underside of the case 2 (see FIGS. 9 and 10). Similarly, the slide contactor 10 is arranged such that a land 10*d* for connection of a lead terminal, indicated in a two-dot chain line in FIG. 7, is exposed in an opening 6 therefor which is provided in the underside of the case 2.

Figure 11:
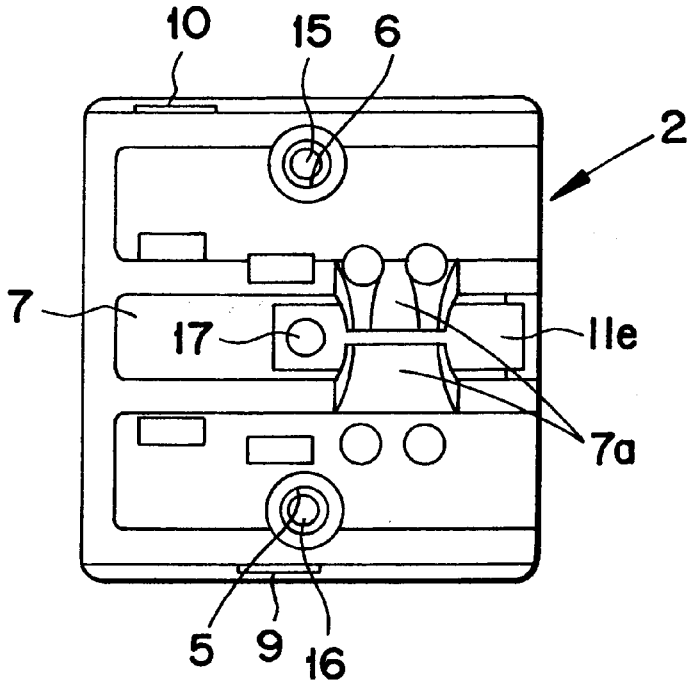
FIG. 11 is a bottom surface view illustrating the case after the lead terminals have been connected thereto.

A led-out or extended portion 11*e* of the slide contactor 11, which is extended from the side surface of the case 2, is bent along the case 2 and, as illustrated in FIG. 11, is directed by a guide groove 7 provided in the underside of the case 2 to follow a prescribed track. Thereby, a forward end portion thereof is disposed at a central part of the underside of the case 2. At this time, as illustrated in FIG. 11, both side wall portions 7*a* at prescribed positions of the guide groove 7 are caulked. As a result of this, the extended portion 11*e* can be firmly fixed to the underside of the case 2 and can be prevented from becoming detached. Furthermore, extended portions 9*e* and 10*e* of the slide contactors 9 and 10, respectively, which are extended from the side surface of the case 2, are cut away in a subsequent step. The slide contactors 9 to 11 are each made of, for example, a copper alloy such as white metal having a spring property or a metal plate such as stainless steel.

As illustrated in FIG. 11, lead terminals 15, 16 and 17 are each circular in cross section. The lead terminals 15 and 16 are bonded, at the end surfaces of their lead wires, to the lead terminal connection lands 9*d* and 10*d* which are exposed in the lead terminal openings 5 and 6 provided in the underside of the case 2 by soldering, resistance welding, ultrasonic welding or other technique. Using the same method, the lead terminal 17 is bonded, at the end surface of its lead wire, to the extended portion 11*e* disposed on the underside of the case 2. In the special case where resistance welding or ultrasonic welding is used as the bonding method, the flux cleaning performed when soldering is used becomes unnecessary. This makes it possible to reduce the manufacturing cost.

Figure 12:
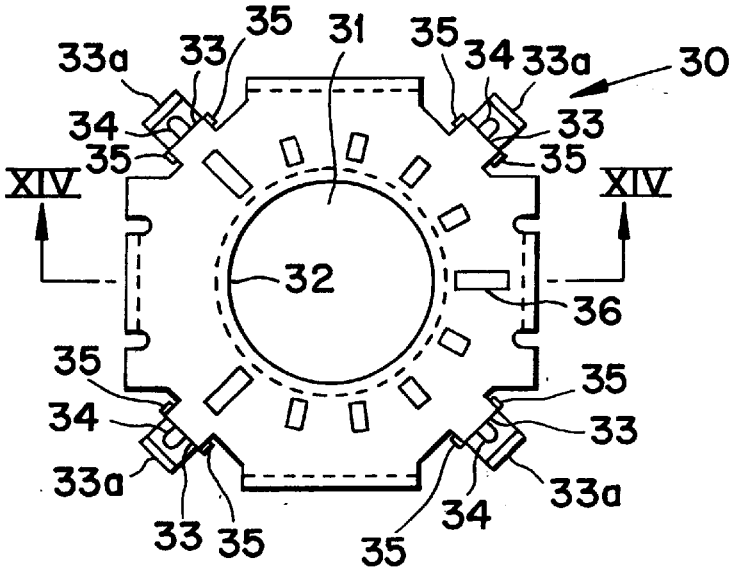
FIG. 12 is a plan view illustrating a metal cover used in the embodiment of the variable resistor.
Figure 13:
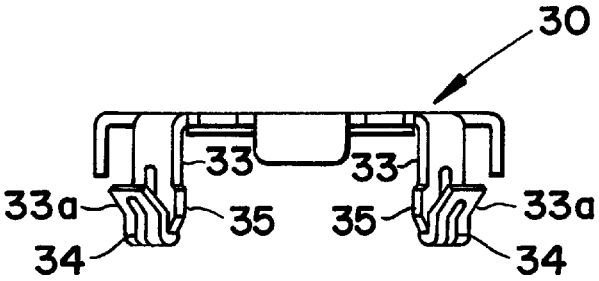
FIG. 13 is a side view illustrating the metal cover illustrated in FIG. 12.
Figure 14:
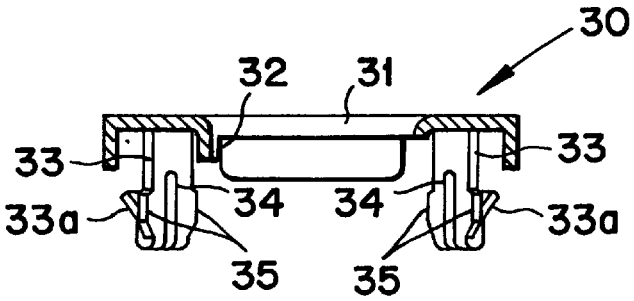
FIG. 14 is a sectional view taken along a line XIV—XIV of the metal cover illustrated in FIG. 12.

As illustrated in FIGS. 12 to 14, the metal cover 30 is provided with an adjusting opening 31 at its central part and has graduations 36 around this opening 31. The graduations 36 are spaced over a range within which the first rotor 118 can be rotated. Also, a tongue-shaped stopper receiver 32 is provided in contact with this opening 31. The edge portion of the adjusting opening 31 is bent and raised toward the first rotor 118 by bending or burring. As a result of this, the insertability of the driver when adjustment is made is enhanced, the strength of the cover 30 itself is increased, the deformation of the top surface of the cover 30 after the mounting thereof is prevented, and the reliability on the contact between the resistor 125, 145 or electrodes 126, 127 or 146, 147 and the contact portions A, B and C of the slide contactors 9 to 11 is enhanced.

Mounting claw portions 33 are provided at four corners of the metal cover 30 in such a way as to have a 180° rotation symmetry about the adjusting opening 31. Therefore, when the metal cover 30 is mounted on the case 2, even if the direction of mounting is rotated through an angle of 180°, the metal cover 30 can be mounted on the case 2 with no difference in terms of the function performed by the variable resistor. Forward end portions 33*a* of the mounting claw portions 33 are folded back. Projections 35 are provided on both sides of each mounting claw portion 33 as viewed in the widthwise direction thereof. Thus, the metal cover 30 has the function of its being prevented from coming off from the case 2. Further, a slit 34 is provided at a central part of the mounting claw portion 33 as viewed in the widthwise direction thereof, with the result that forced insertion into the case 2 is facilitated and simultaneously the retention force can be increased. The metal cover 30 is made of metal material such as stainless steel or the like.

Figure 15:
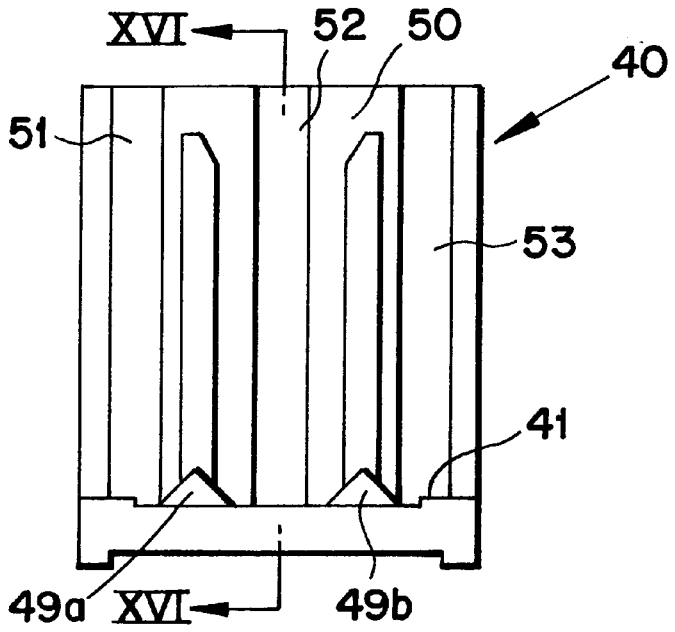
FIG. 15 is a front view illustrating an adaptor used in the embodiment of the variable resistor.
Figure 16:
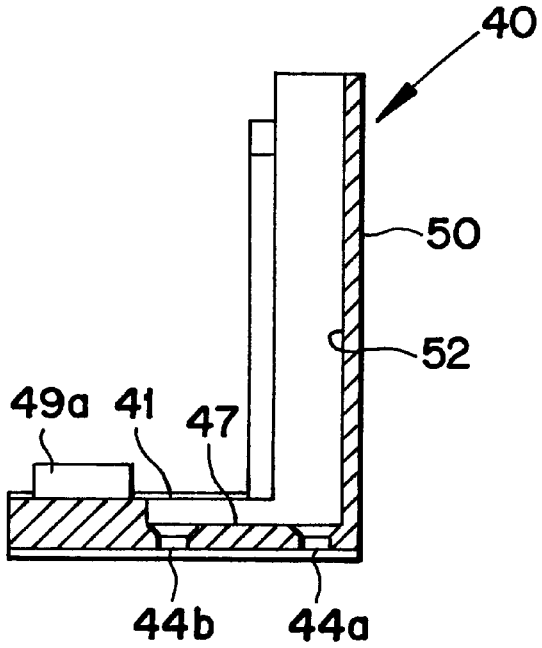
FIG. 16 is a sectional view taken along a line XVI—XVI of tie adaptor illustrated in FIG. 15.
Figure 17:
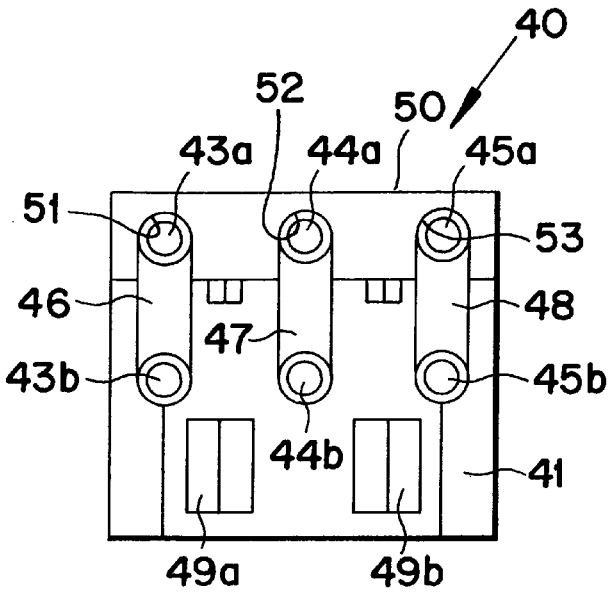
FIG. 17 is a plan view illustrating the adaptor illustrated in FIG. 15.

As illustrated in FIGS. 15 to 17, an adaptor 40 is substantially shaped like a character "L" and has a pedestal portion 41 having the case 2 placed thereon and a rear plate portion 50. The pedestal portion 41 has provided therein grooves 46, 47 and 48 for respectively accommodating the bent lead terminals 15, 16 and 17 therein. Both end portions of the grooves 46 to 48 are provided with through holes 43*a* and 43*b*, 44*a* and 44*b*, and 45*a* and 45*b* for insertion of the lead terminals 15 to 17 therethrough. The lead terminal 15 is inserted through either one of the through openings 43*a* and 43*b*, the lead terminal 16 is inserted through either one of the through openings 45*a* and 45*b* and the lead terminal 17 is inserted through either one of the through openings 44*a* and 44*b*. As a result of this, the dimension of the lead terminal pitch is stably maintained. Further, the pedestal portion 41 is provided with fusion spaces 49*a* and 49*b* for fusing the case 2 by ultrasonic waves or the like.

The rear plate portion 50 is provided with grooves 51, 52 and 53 for respectively accommodating the bent lead terminals 15, 16 and 17 therein. The adaptor 40 is made of, for example, polyamide system nylon having a high resistance to heat such as 46 nylon, or thermoplastic resin such as polyphenylene sulfide, polybutylene terephthalate or liquid crystal polymer, or the like. By especially using the same material that the case 2 is made of, the fusion between the adaptor 40 and the case 2 is improved with the result that the strength of the resulting structure becomes high.

Figure 19:
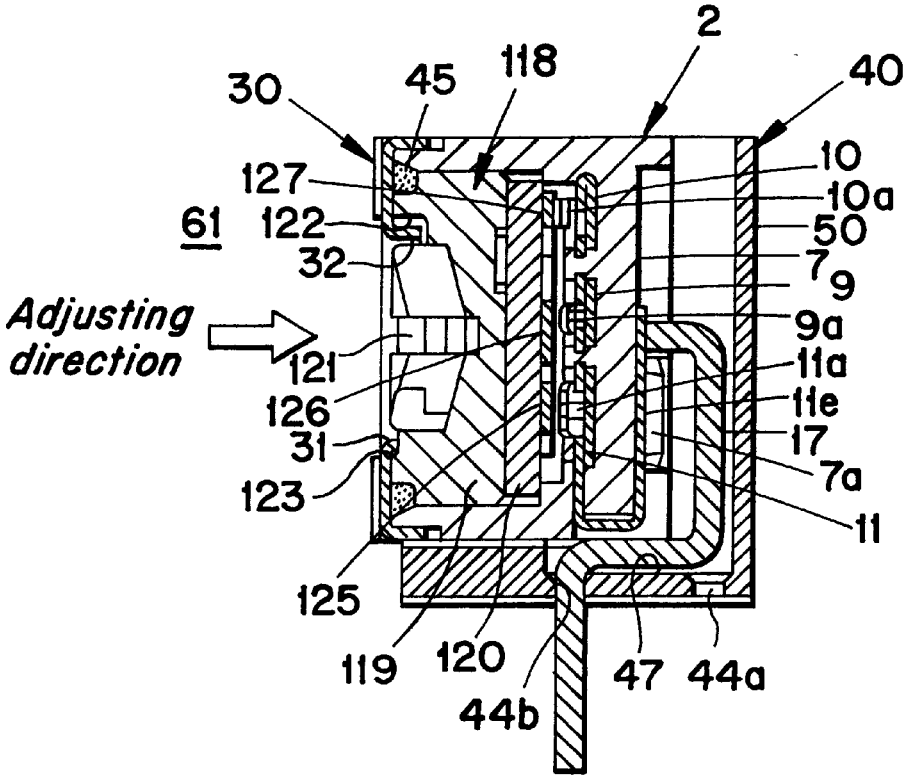
FIG. 19 is a sectional view taken along a line XIX—XIX of the variable resistor illustrated in FIG. 18.

An O-ring 45 for providing a seal illustrated in FIG. 19 is made of, for example, silicone rubber. The O-ring is accommodated in the notch 124 or 144 of the first or second rotor 118 or 138 and provides a sealing function between the cover 30 and the case 2. By using a silicone rubber having a hardness of 60° to 70°, for example, It is possible to reduce the amount of the backlash of the first or second rotor 118 or 138 occurring when rotation adjustment is made by a driver.

Figure 18:
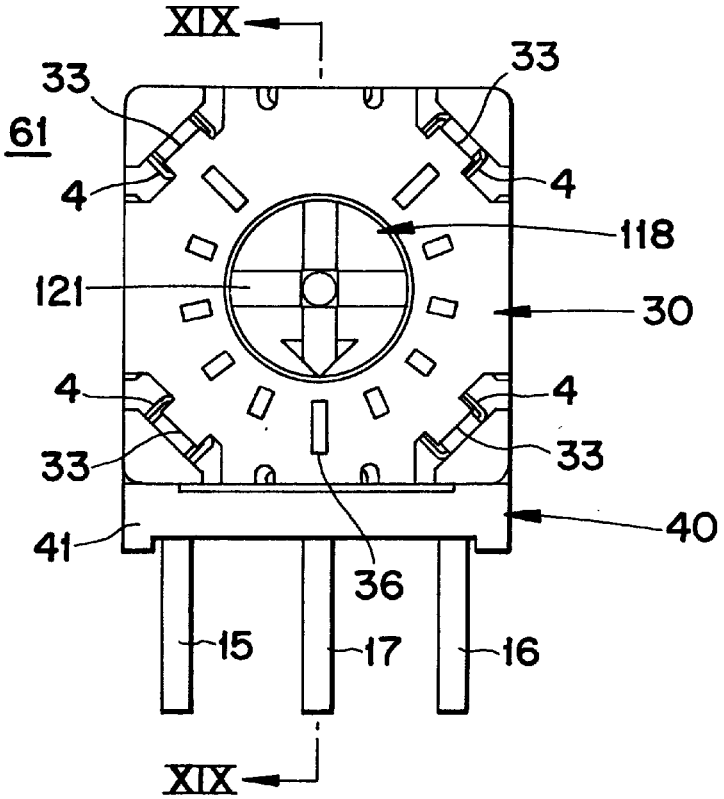
FIG. 18 is a front view illustrating the variable resistor wherein the first rotor is accommodated in the case.

The above-described constituent parts are assembled in accordance with the following procedure. That is, as illustrated in FIGS. 18 and 19, the first rotor 118 is accommodated in the recess portion 3 of the case 2 in such a way that the resistor 125 and the electrodes 126 and 127 thereof respectively contact with the contact portions C, A and B. Next, the O-ring 45 is inserted in the gap between the outer-peripheral edge portion 124 of the first rotor 118 and the case 2. Thereafter, the metal cover 30 is lidded over the case 2, such that the portion where no graduation 36 are made is oriented in a direction opposite to that of the terminal 11*e* led out from the case 2. Subsequently, the mounting claw portions 33 are inserted by force into the holes 4 of the case 2. Thereby, the metal cover 30 is firmly mounted on the case 2 in a state where the first rotor 118 is confined in the recess portion 3. As a result of this, the case 2 is sealed, and accordingly the conventional sealing operation performed using resin can be omitted, and the number of the assembling steps can be reduced. In addition, the displacement of the contact portions between the resistor 125 and the electrodes 126, 127 and their corresponding contact portions A to C are suppressed, and thereby the setting of the resistance values is stabilized.

Next, the lead terminals 15 to 17 are subjected to initial sending along the rear surface of the case 2 and the forward end portions thereof are led out in a direction substantially perpendicular to the side surface of the case 2. Further, after having been bent along the side surface of the case 2 so as to have various required terminal pitch dimensions, the lead terminals are subjected to second bending in a direction substantially perpendicular to the side surface of the case 2, provided, however, that this second bending is performed with respect to only the lead terminal needed to be bent. Thereafter, the lead terminals 15 to 17 are inserted into the through-holes 43*a* to 45*b* of the adaptor 40 which correspond to the required terminal pitches. Thereby, the case 2 is placed on the adaptor 40. FIGS. 18 and 19 illustrate a case where the lead terminals 15, 16 and 17 are respectively inserted into the through-holes 43*b*, 45*b* and 44*b* of the adaptor 40. The side surface of the case 2, from which the forward end portions of the lead terminals 15 to 17 are led out, and the adaptor 40 are fused together via the fusion spaces 49*a* and 49*b* by ultrasonic welding or the like. Therefore, no engagement portion of a special configuration for use in bonding the case 2 and the adaptor 40 is needed to be provided on the case 2 and adaptor 40. This makes it possible to configure each of the case 2 and adaptor 40 using a simple structure.

A variable resistor 61 which has been assembled in the above-described manner is of a side surface adjusting type. That is, a forward end portion of the driver is applied from an arrow-indicated direction illustrated in FIG. 19 to the for-use-of-driver crossed groove 121 of the first rotor 118 to thereby rotate the first rotor 118. Through this rotation the contact portion C is brought into sliding contact with the resistor 125, the contact portion A is brought into sliding contact with the inner-peripheral electrode 126, and the contact portion B is brought into sliding contact with the outer-peripheral electrode 127 to cause variation of the resistance value between the terminals 15 and 17 and the resistance value between the terminals 16 and 17.

Figure 20:
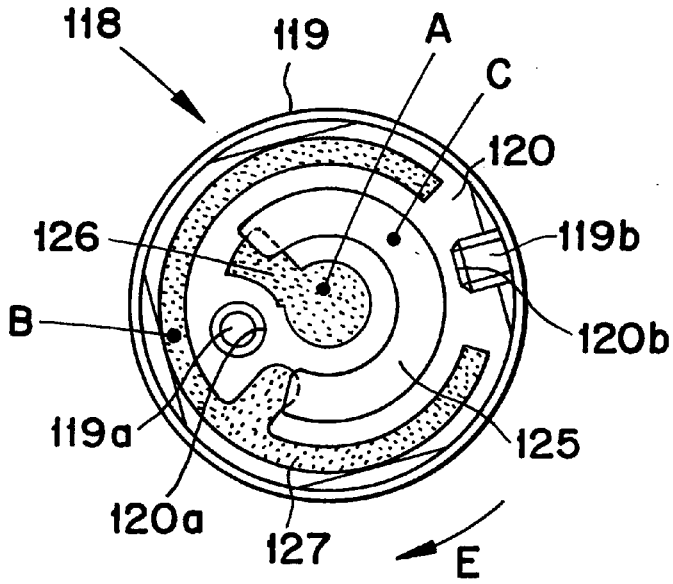
FIG. 20 is an explanatory view of the rotation direction of the first rotor and the terminal numbers.
Figure 38:
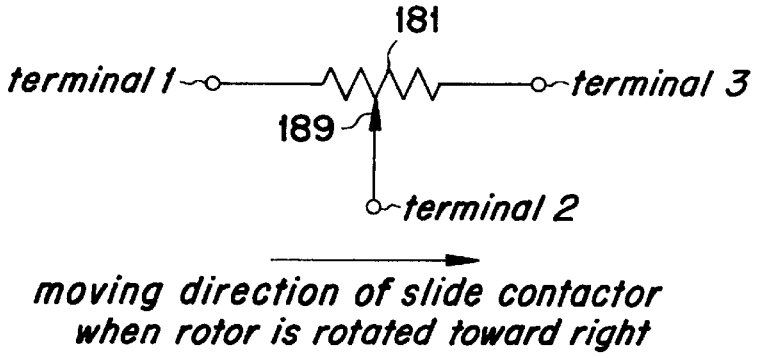
FIG. 38 (PRIOR ART)
FIG. 38 is an explanatory view of the terminal numbers of the variable resistor.

The relationship between the resistance-value varying first rotor 118 and the terminal number will now be explained with reference to FIG. 20. For example, in order to make the resistance value small between the contact portion A coming into sliding contact with the inner-peripheral electrode 126 and the contact portion C coming into sliding contact with the resistor 125, the first rotor 118 is rotated in an arrow E-indicated direction. When applying this relationship to FIG. 38, the contact portion A corresponds to the terminal number 1 and so the lead terminal 16 connected to the contact portion A is the terminal number 1. Accordingly, the lead terminal 15 connected to the remaining contact portion B is the terminal number 3. It is to be noted that the stopper receiver 32 provided on the metal cover mounted on the case 2 is disposed in the escape groove 122 provided in the first rotor 118. This stopper receiver 32 regulates the stopper 123 provided in the first rotor 118 to regulate the rotation angle of the first rotor 118.

Figure 21:
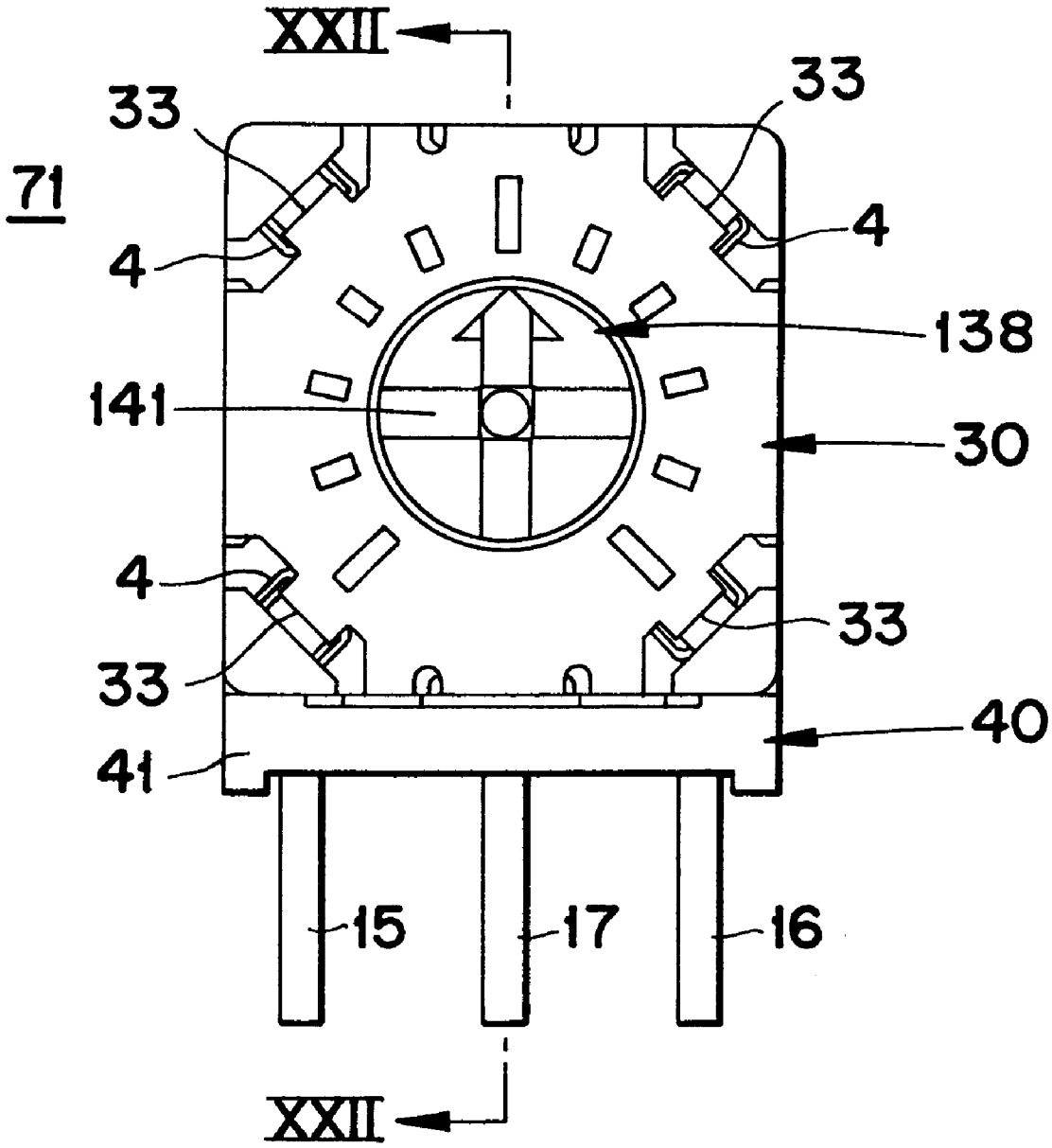
FIG. 21 is a front view illustrating the variable resistor wherein the second rotor is accommodated in the case.
Figure 22:
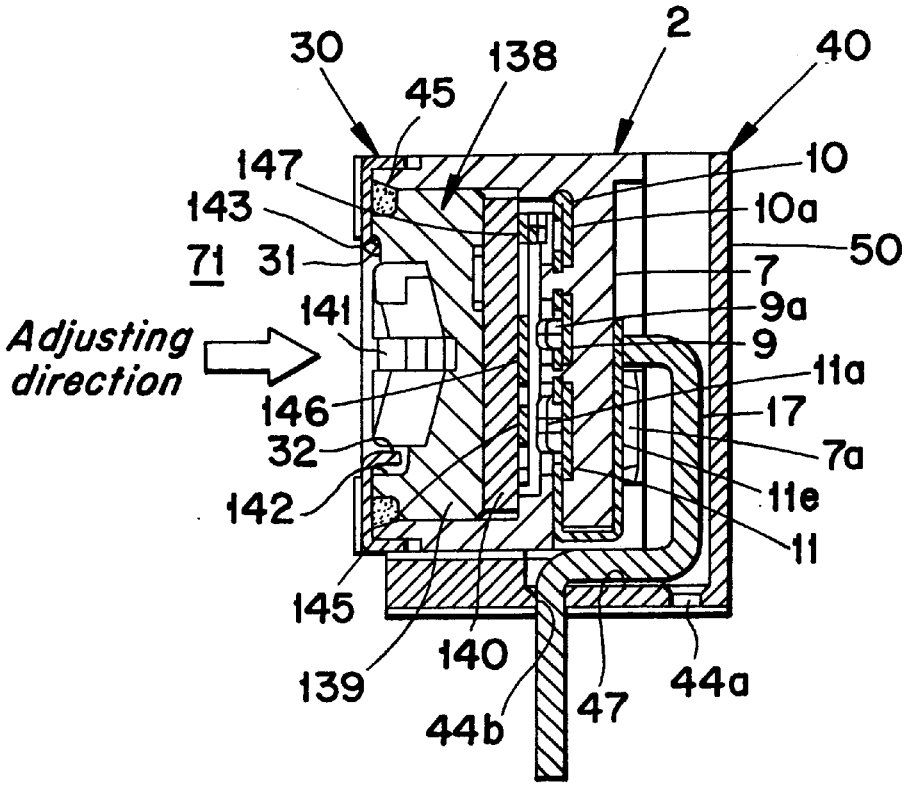
FIG. 22 is a sectional view taken along a line XXII—XXII of the variable resistor illustrated in FIG. 21.

The second rotor 138 is also similarly accommodated in the recess portion 3 of the case 2. That is, as illustrated in FIGS. 21 and 22, the second rotor 138 is accommodated in the recess portion 3 of the case 2 in such a way that the resistor 145 and the electrodes 146 and 147 thereof respectively contact with the contact portions C, A and B. Next, the O-ring 45 is inserted in the gap between the outer-peripheral edge portion 144 of the second rotor 138 and the case 2. Thereafter, the metal cover 30 is rotated through an angle of 180° with respect to the metal cover 30 of the first rotor 118 and is lidded onto the case 2 from above the same. Subsequently, the mounting claw portions 33 are inserted by force into the holes 4 of the case 2. Thereby, the metal cover 30 is firmly mounted on the case 2 in a state where the second rotor 138 is confined in the recess portion 3.

Next, the lead terminals 15 to 17 are subjected to initial bending along the rear surface of the case 2 and the forward end portions thereof are led out in a direction substantially perpendicular to the side surface of the case 2. This leading-out direction is the same as that in the case where assembling is performed using the first rotor 118. Further, after having been bent along the side surface of the case 2 so as to have various required terminal pitch dimensions, the lead terminals are subjected to second bending in a direction substantially perpendicular to the side surface of the case 2, provided, however, that this second bending is performed with respect to only the lead terminal needed to be bent. Thereafter, the lead terminals 15 to 17 are inserted into the through-holes 43*a* to 45*b* of the adaptor 40 which correspond to the required terminal pitches. Thereby, the case 2 is placed on the adaptor 40. FIGS. 21 and 22 illustrate a case where the lead terminals 15, 16 and 17 are respectively inserted into the through-holes 43*b*, 45*b* and 44*b* of the adaptor 40. The side surface of the case 2, from which the forward end portions of the lead terminals 15 to 17 are led out, and the adaptor 40 are fused together via the fusion spaces 49*a* and 49*b* by ultrasonic welding or the like. Here, the case 2 having the second rotor 138 accommodated therein is at all times fused to the adaptor 40 at its side surface, the same as that at which the case 2 having the first rotor 118 accommodated therein is fused to the adaptor 40. This makes it possible to configure each of the case 2 and adaptor 40 using a simple structure. This reduces the cost of the parts including the dies for the case 2 and adaptor 40.

A variable resistor 71 which has been assembled in the above-described manner is of a side surface adjusting type. That is, the forward end portion of the driver is applied from an arrow-indicated direction illustrated in FIG. 22 to the for-use-of-driver crossed groove 141 of the second rotor 138 to thereby rotate the second rotor 138. Through this rotation, the contact portion C is brought into sliding contact with the resistor 145, the contact portion A is brought into sliding contact with the inner-peripheral electrode 146, and the contact portion B is brought into sliding contact with the outer-peripheral electrode 147 to cause variation of the resistance value between the terminals 15 and 17 and the resistance value between the terminals 16 and 17.

Figure 23:
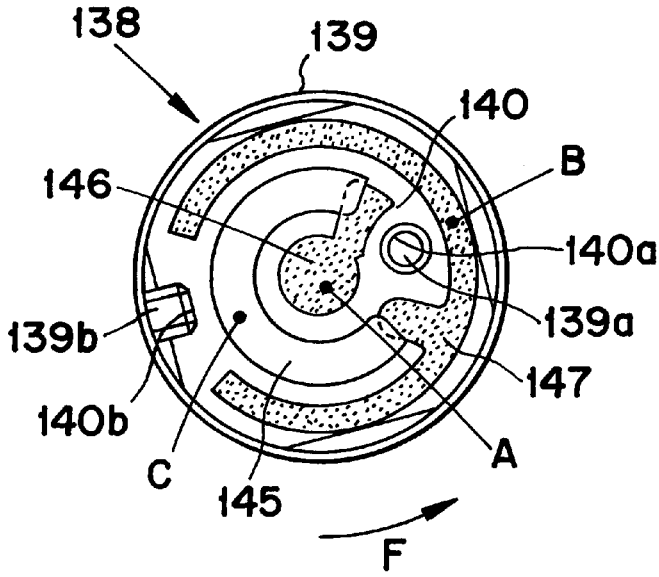
FIG. 23 is an explanatory view of the rotation direction of the second rotor and the terminal numbers.

The relationship between the resistance-value varying second rotor 138 and the terminal number will now be explained with reference to FIG. 23, in the same way as in the case of the above-described first rotor 118. For example, in order to make the resistance value small between the contact portion A coming into sliding contact with the inner-peripheral electrode 146 and the contact portion C coming into sliding contact with the resistor 145, the second rotor 138 is rotated in an arrow F-indicated direction. It follows from this rotation direction that the contact portion A corresponds to the terminal number 3 and so the lead terminal 16 connected to the contact portion A is the terminal number 3. Accordingly, the lead terminal 15 connected to the remaining contact portion B is the terminal number 1.

In the variable resistors 61 and 71 having the above-described constructions, as illustrated in FIG. 24, the initial bending of the initial lead terminals 15 to 17 is performed in the same direction. The subsequent bending of the lead terminals is three in kind. Furthermore, as explained with reference to FIGS. 20 and 23, the terminal number 1 can be interchanged with the terminal number 3 by appropriately combining two kinds of rotors, i.e., first rotor 118 and second rotor 138 with one kind of case, i.e., case 2. Accordingly, the method of initial bending of the lead terminals 15 to 17 can be reduced from the conventional two kinds of bending operations to one kind of bending operation. The direction of subsequent bending of the lead terminals 15 to 17 can be reduced from the conventional six kinds of bending operations to three kinds of bending operations. As a result, the assembling and lead terminal bending steps can be simplified and therefore it is possible to facilitate the manufacture and management of the side surface adjusting type variable resistor, thus reducing the manufacturing cost and enhancing the productivity.

The reason why the metal cover is mounted by being rotated through an angle of 180° according to the selective use of one of the first rotor 118 and the second rotor 138 is for the purpose of regulating the rotation range of each of the first rotor 118 and second rotor 138 and thereby ensuring that the contact portions A, B and C do not slide off of their prescribed slide range of the resistor 125 or 145, inner-peripheral electrode 126 or 146 and outer-peripheral electrode 127 or 147 by which the contact portions A, B and C are contacted in sliding engagement.

The variable resistor according to the present invention is not limited to the above-described embodiment and can be modified in various ways without departing from the spirit and scope of the invention.

Although in the above-described embodiment, reference has been made to the structure wherein the slide contactor and the lead terminal are each configured as separate members, the led-out portion of the slide contactor can be extended and this extended portion can function as a lead terminal.

Also, the device can be configured to electrically connect the outer-peripheral electrode 127 or 147 or inner-peripheral electrode 126 or 146 to only either one end portion of the resistors 125 or 145.

Figure 26:
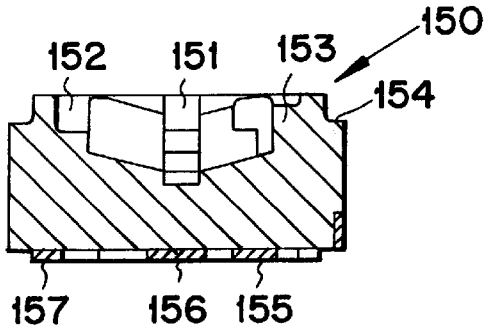
FIG. 26 is a sectional view taken along a line XXVI—XXVI of the first rotor illustrated in FIG. 25.
Figure 27:
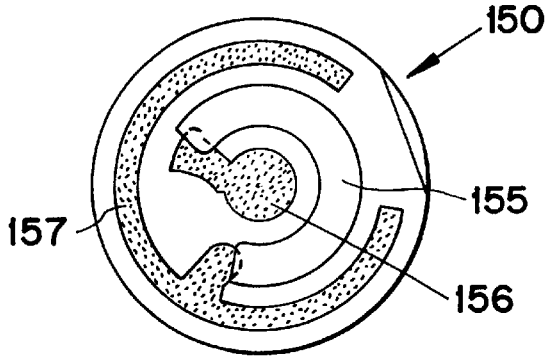
FIG. 27 is a bottom surface view illustrating the first rotor illustrated in FIG. 25.

Also, the first and second rotors are each not necessarily composed of the substrate having the resistor and electrodes provided on the surface thereof and the main body. Rather, the rotors can each be configured in accordance with the rotor 150 illustrated in, for example, FIGS. 25 to 27. This rotor 150 is described as the first rotor but the same principles can be applied to the second rotor. This rotor 150 is substantially shaped as a circular column and has an insulating structure made of, for example, resin or ceramic. At a central part of the upper surface of this rotor 150 there is provided a crossed groove 151 for use in conjunction with a driver. Around the crossed groove 151 there is provided an escape groove 152 substantially shaped like a circular arc. Further, a stopper 153 is provided at a prescribed position of this escape groove 152. A notch 154 is provided in the outer-peripheral edge portion of the upper surface of the rotor 150. On the underside of the rotor 150 there are concentrically formed a horseshoe resistor 155, inner-peripheral electrode 156 and outer-peripheral electrode 157.

Figure 28:
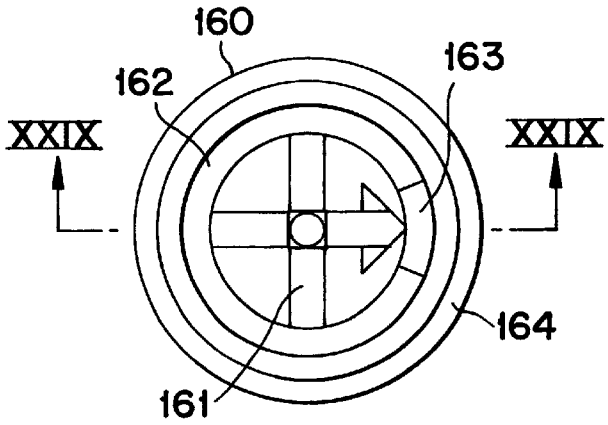
FIG. 28 is a plan view illustrating a main body of each of a first rotor and second rotor used in still another embodiment of the present invention.
Figure 29:
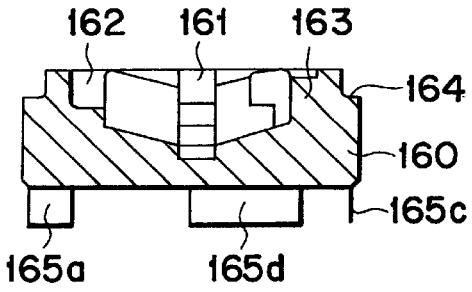
FIG. 29 is a sectional view taken alone a line XXIX—XXIX of the main body illustrated in FIG. 28.
Figure 30:
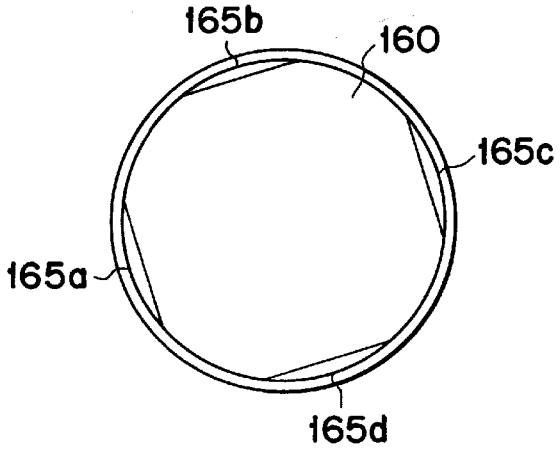
FIG. 30 is a bottom surface view illustrating the main body illustrated in FIG. 28.

Also, although the first and second rotors of the above-described embodiment make it necessary to prepare two kinds of the substrates having the resistor and electrodes provided on the surface thereof and the main body, using a main body 160 illustrated in FIGS. 28–30 enables the construction of the first and second rotors each having a common main body and thereby further reduces the number of different parts required. That is, at a central part of the upper surface of the main body 160 there is provided a crossed groove 161 for use in conjunction with a driver. Around the crossed groove 161 there is provided an escape groove 162 substantially shaped like a circular arc. Further, a stopper 163 is provided at a prescribed position of this escape groove 162. A notch 164 is provided in the outer-peripheral edge portion of the upper surface of the main body 160. On the outer-peripheral edge portion of the underside of the main body 160 there are provided guide projections 165*a*, 165*b*, 165*c* and 165*d* at equal intervals.

Figure 31:
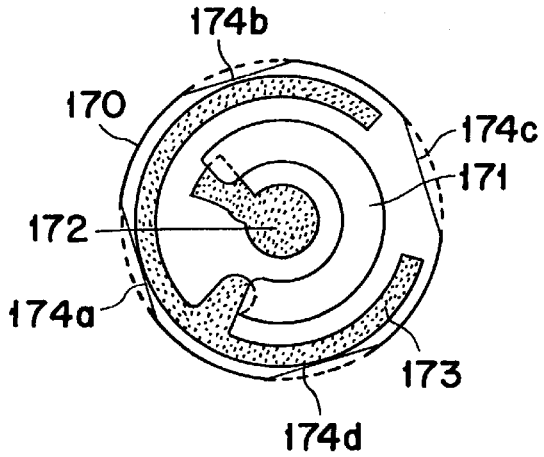
FIG. 31 is a bottom surface view illustrating a substrate combined with the main body illustrated in FIG. 28.
Figure 32:
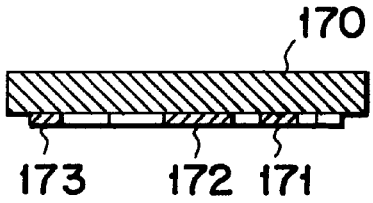
FIG. 32 is a sectional view illustrating the substrate illustrated in FIG. 31.

As illustrated in FIGS. 31 and 32, in the outer-peripheral edge portion of the substrate 170 there are provided notches 174*a*, 174*b*, 174*c* and 174*d*, whose configurations are made to conform with those of the guide projections 165*a* to 165*d*. By clamping the substrate 170 by the guide projections 165*a* to 165*d*, the displacement between the main body 160 and the substrate 170 due to the rotation thereof is prevented. Further, a horseshoe resistor 171 is provided on the underside of the substrate 170. End portions of the resistor 171 are electrically connected to an inner-peripheral electrode 172 and an outer-peripheral electrode 173. The inner-peripheral electrode 172 and outer-peripheral electrode 173 are formed concentrically with the horseshoe resistor 171. The inner-peripheral electrode 172 has a circular portion at the central part of the substrate 170 while, on the other hand, the outer-peripheral electrode 173 has a circular arc portion at the outer-peripheral part of the substrate 170.

Figure 33:
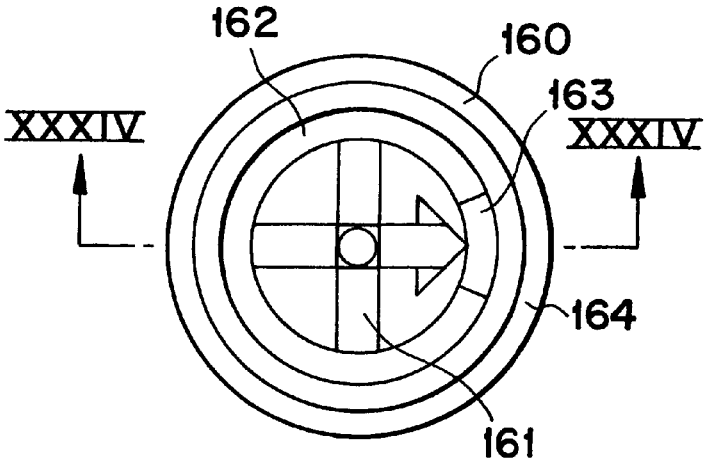
FIG. 33 is a plan view illustrating the first rotor wherein the main body illustrated in FIG. 28 and the substrate illustrated in FIG. 31 are combined with each other.
Figure 34:
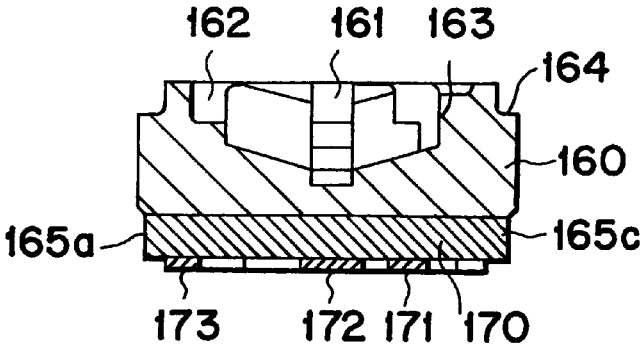
FIG. 34 is a sectional view taken along a line XXXIV—XXXIV of the first rotor illustrated in FIG. 33.
Figure 37:
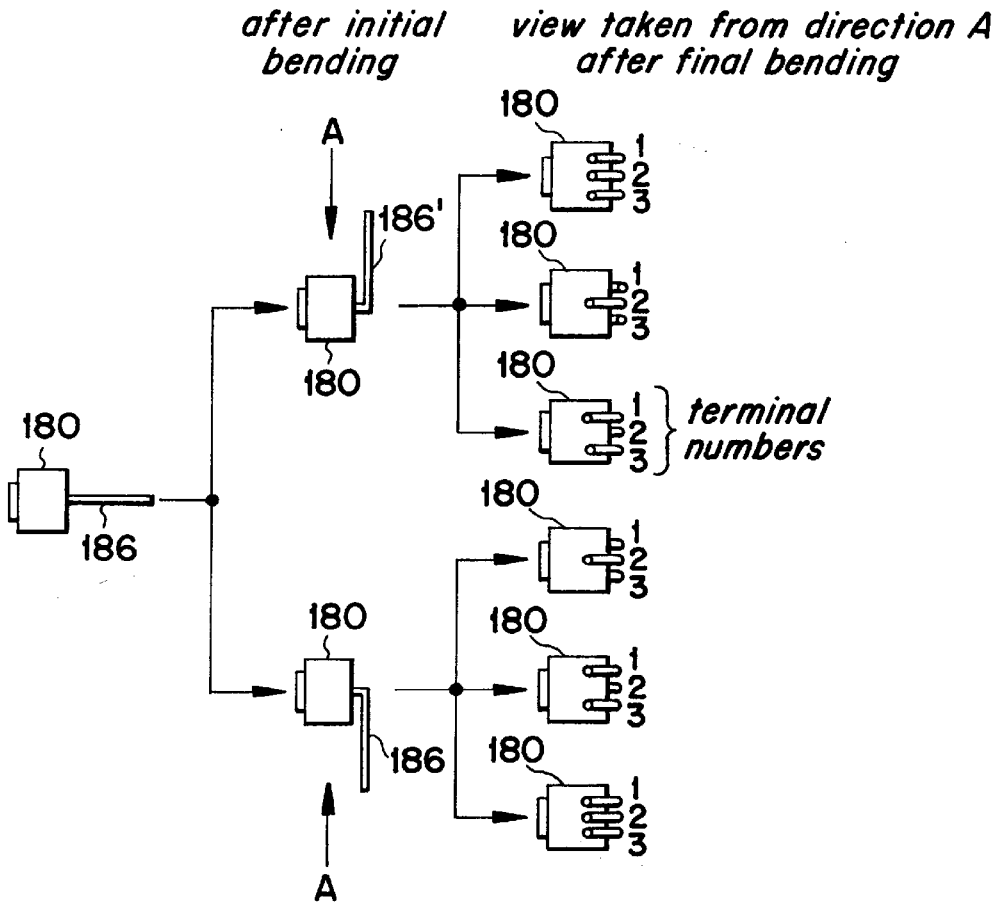
FIG. 37 (PRIOR ART)
FIG. 37 is an explanatory view illustrating the kind of the bending methods (operations) for the conventional variable resistor.

As illustrated in FIGS. 33 to 35, by bonding this substrate 170 to the underside of the main body 160, the first rotor is provided. Furthermore, by bonding a main body the same as the main body 160 and a substrate having provided on its surface a resistor and electrodes symmetrical with those 171, 172 and 173, a second rotor is provided.

As apparent from the foregoing description according to the present invention, by selecting either one of the first rotor having provided thereon the resistor and electrodes and the second rotor having provided thereon a resistor and electrodes symmetrical with those of the first rotor at the position obtained by rotating these elements through an angle of 180° with respect to the first rotor and accommodating the selected rotor in the case, the terminal numbers can be changed and the initial bending of the terminal can be reduced from the conventional two kinds of bending operations to one kind of bending operation. As a result, it is possible to facilitate the manufacture and management of the side surface adjusting type variable resistor and thereby reduce the manufacturing cost and enhance the productivity.

Also, since the cover has the mounting claw portions disposed at equal intervals, when the cover is mounted on the case, the cover can be mounted also in a mounting direction different 180° from another with no difference in function being made therebetween. Accordingly, one kind of cover can be commonly mounted both on the first rotor accommodated case and on the second rotor accommodated case to thereby reduce the number of the parts used. Further, since the cover is made to seal the case by being firmly mounted on the case, it is possible to omit the conventional sealing operation based on the use of resin and thereby reduce the number of the assembling steps.

Also, since the forward end portions of the mounting claw portions are folded back and in addition the slits and engagement portions are provided in and on these mounting claw portions whereby these mounting claw portions of the cover are inserted by force into the openings provided in the case, the function of preventing the cover from coming off can be enhanced. Further, by performing the bending or burring of the edge portion of the adjusting hole toward the rotor side, the insertability of the driver at the adjusting time is enhanced, the strength of the cover itself is increased, the deformation of the top surface of the cover after the mounting of the cover is prevented, and the contact reliability of the contact between the resistor or electrodes and the contact portions of the slide contactors is enhanced.

Also, using the adaptor for maintaining the terminal pitch dimension, the terminal pitch dimension can be maintained in a stable condition.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A variable resistor comprising:

a case having a recess formed therein, said recess having a bottom surface;

a plurality of slide contactors disposed on said bottom surface of said recess;

a rotor which is rotationally received in said recess, said rotor including a surface containing a resistor, and an electrode connected to at least one end of said resistor, wherein said resistor and said electrode engage respective slide contactors at a plurality of respective contact portions, the rotor comprising either a first rotor or a second rotor having different symmetrical orientations of said resistor and electrode formed on their respective rotor surfaces;

a plurality of terminals electrically connected to the respective contact portions; and a cover disposed over an opening of said recess;

wherein said case, slide contactors and cover are configured to accommodate either said first rotor or said second rotor.

2. The variable resistor according to claim 1, wherein said first rotor has a first orientation of said resistor and electrode, and said second rotor has a second orientation of said resistor and electrode, wherein said second orientation is rotated by an angle of 180° with respect to the first orientation.

3. The variable resistor according to claim 2, where said first and second orientations are selected by choosing a first and second rotors having said first and second orientations of said resistor and said electrode formed on a surface thereof, respectively.

4. The variable resistor according to claim 2, wherein said first and second orientations are provided by a rotor having a common main body and an attachable substrate part, wherein said attachable substrate part has said resistor and said electrode formed thereon in one of said first or said second orientations.

5. The variable resistor according to claim 4, wherein said main body part has at least one guide projection which engages a notch formed in said substrate to align said main body part which said substrate.

6. The variable resistor according to claim 1, wherein the resistor provided on said rotor has a horseshoe-like shape and the electrode is formed concentrically with the horseshoe shaped resistor.

7. The variable resistor according to claim 1, wherein the cover has mounting claw portions disposed in 180° rotation symmetry about a rotation axis of the rotor, and these mounting claw portions are inserted by force into holes provided in the case, whereby the cover is mounted on the case.

8. The variable resistor according to claim 1, wherein the cover has an adjusting opening at its central part and at least one of bending and burring is performed of the edge portion of said adjusting opening toward a side of the rotor.

9. The variable resistor according to claim 1, wherein the rotor is made of insulating resin or ceramic.

10. The variable resistor according to claim 1, wherein said terminals are bent to one terminal bending permutation selected from a set of terminal bending permutations.

11. The variable resistor according to claim 10, further comprising an adaptor for maintaining the pitch of said terminals.

12. The variable resistor according to claim 1, further comprising a sealing O-ring mounted between the rotor and the cover.

13. An assembly for constructing a variable resistor comprising:

a case having a recess formed therein, said recess having a bottom surface;

a plurality of slide contactors disposed on said bottom surface of said recess;

a first rotor which can be rotationally received in said recess, said first rotor including a surface containing a first resistor, and a first electrode connected to at least one end of said first resistor, wherein said first resistor and said first electrode engage respective slides contactors;

a second rotor which can be rotationally received in said recess, said second rotor including a surface containing a second resistor, and a second electrode connected to at least one end of said second resistor, wherein said second resistor and said second electrode engage respective slides contactors, wherein the orientation of said second resistor and second electrode is symmetric with the orientation of said first resistor and said first electrode;

a plurality of terminals connected to respective slide contactors; and a cover disposed over an opening of said recess;

wherein said case, slide contactors and cover are configured to accommodate and receive said first or second rotors.

* * * * *